US008614657B2

(12) United States Patent
Han et al.

(10) Patent No.: US 8,614,657 B2
(45) **Date of Patent: *Dec. 24, 2013**

(54) ORGANIC LIGHT EMITTING DISPLAY DEVICE HAVING TWO POWER DRIVERS FOR SUPPLYING DIFFERENT POWERS, AND DRIVING METHOD THEREOF

(75) Inventors: Sang-Myeon Han, Yongin (KR); Baek-Woon Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 285 days.

This patent is subject to a terminal disclaimer.

(21) Appl. No.: 12/964,636

(22) Filed: Dec. 9, 2010

(65) Prior Publication Data

US 2011/0279484 A1 Nov. 17, 2011

(30) Foreign Application Priority Data

May 13, 2010 (KR) ..... 10-2010-0044902

(51) Int. Cl.
*G09G 3/30* (2006.01)

(52) U.S. Cl.
USPC ..... 345/77

(58) Field of Classification Search
USPC ..... 345/76–82, 211–214, 690
See application file for complete search history.

(56) References Cited

U.S. PATENT DOCUMENTS

2006/0244695 A1* 11/2006 Komiya ..... 345/76
2007/0164959 A1 7/2007 Childs
2007/0229411 A1* 10/2007 Choi ..... 345/76
2008/0150846 A1* 6/2008 Chung ..... 345/80
2008/0284691 A1* 11/2008 Chung et al. ..... 345/76
2009/0284519 A1* 11/2009 Kim et al. ..... 345/213
2009/0309818 A1* 12/2009 Kim ..... 345/77

FOREIGN PATENT DOCUMENTS

JP 2009-139820 6/2009
KR 100646989 B1 11/2006
KR 1020060114456 A 11/2006
KR 10-2009-0023639 A 3/2009
KR 10-2009-0058319 A 6/2009
KR 1020100009219 A 1/2010

OTHER PUBLICATIONS

Office Action dated Oct. 10, 2011 issued to Korean Priority Application No. 10-2010-0044902, 1 page.

* cited by examiner

*Primary Examiner* — Dennis Joseph
(74) *Attorney, Agent, or Firm* — Christie, Parker & Hale, LLP

(57) ABSTRACT

An organic light emitting display device operating in a concurrent (e.g., simultaneous) emission method, which includes a first power driver configured to apply first power, which changes between a first low level and a first high level, to pixels of the display unit, and a second power driver configured to apply second power, which changes between a second low level and a second high level, to the pixels, wherein each of the pixels includes an organic light emitting diode, a driving transistor configured to control an amount of current supplied to the organic light emitting diode, and an initializing transistor coupled to an anode electrode of the organic light emitting diode and configured to be turned on during a reset period in one frame to supply a reset voltage, which is lower than the first high level of the first power, to the anode electrode of the organic light emitting diode.

8 Claims, 11 Drawing Sheets

ORGANIC LIGHT EMITTING DISPLAY DEVICE HAVING TWO POWER DRIVERS FOR SUPPLYING DIFFERENT POWERS, AND DRIVING METHOD THEREOF

CROSS-REFERENCE TO RELATED APPLICATIONS

This application claims priority to and the benefit of Korean Patent Application No. 10-2010-0044902, filed on May 13, 2010, in the Korean Intellectual Property Office, the entire content of which is incorporated herein by reference.

BACKGROUND

1. Field

Embodiments of the present invention relate to an organic light emitting display device and a driving method thereof.

2. Discussion of Related Art

Recently, a variety of flat panel displays that makes it possible to reduce the faults, the weight, and the volume of cathode ray tubes, has been developed. Typical flat panel displays include liquid crystal displays, field emission displays, plasma display panels, and organic light emitting display devices, etc.

The organic light emitting display device of the flat panel display devices displays an image using organic light emitting diodes that emit light by the recombination of electrons and holes, and has high response speed, and is driven at low power consumption.

In general, the organic light emitting display devices are classified into passive matrix organic light emitting display devices (PMOLEDs) and active matrix organic light emitting display devices (AMOLEDs), in accordance with the method of driving the organic light emitting diodes.

The active matrix organic light emitting display device includes a plurality of scan lines, a plurality of data lines, a plurality of power source lines, and a plurality of pixels coupled with the lines and arranged in a matrix. Each of the pixels typically includes an organic light emitting diode, a driving transistor for controlling the amount of current supplied to the organic light emitting diode, a switching transistor for transmitting a data signal to the driving transistor, and a storage capacitor for maintaining a voltage of the data signal.

The active matrix organic light emitting display device has the advantage of consuming low power, but has a problem that display is not uniform because the magnitude of current flowing through an organic light emitting element is changed due to a voltage difference between a gate and a drain of a driving transistor that drives the organic light emitting element, that is, a threshold voltage difference between the driving transistors in different pixels.

That is, properties of the transistors included in pixels are changed by variables in the manufacturing process, and accordingly, the threshold voltage difference of the driving transistors exists between the pixels. Currently, a compensating circuit that can compensate for the threshold voltage of the driving transistors is used to reduce the non-uniformity between the pixels.

The compensating circuit, however, additionally includes a plurality of transistors, capacitors, and signal lines for controlling the transistors. Therefore, the pixel including the compensating circuit has a problem that the aperture ratio is decreased and the possibility of defect increases.

SUMMARY

Embodiments of the present invention provide a pixel including two transistors and two capacitors. Further, embodiments of the present invention provide an organic light emitting display device that can display an image with desired luminance regardless of the threshold voltage of a driving transistor by driving pixels in a concurrent (e.g., simultaneous) emission method, and a method of driving the organic light emitting display device.

According to an aspect of embodiments of the present invention, there is provided an organic light emitting display device including a display unit including pixels coupled to scan lines and data lines, control lines coupled to the pixels, a control line driver configured to supply control signals to the pixels through the control lines, a first power driver configured to apply first power, which changes between a first low level and a first high level, to the pixels, and a second power driver configured to apply second power, which changes between a second low level and a second high level, to the pixels, wherein each of the pixels includes an organic light emitting diode, a driving transistor configured to control an amount of current supplied to the organic light emitting diode, and an initializing transistor coupled to an anode electrode of the organic light emitting diode and configured to be turned on during a reset period in one frame to supply a reset voltage, which is lower than the first high level of the first power, to the anode electrode of the organic light emitting diode.

The organic light emitting display device may further include a scan driver configured to supply scan signals to the scan lines, a data driver configured to supply data signals to the data lines in synchronization with the scan signals, and a timing controller configured to control the scan driver, the data driver, and the control line driver.

The first power driver may be configured to supply the first power at the first high level during a period in which the pixels are charged with a voltage corresponding to a threshold voltage of the driving transistor and data signals and during a period in which the pixels emit light, and may be configured to supply the first power at the first low level during other periods.

The second power driver may be configured to supply the second power at the second low level during a period in which the pixels concurrently emit light, and may be configured to supply the second power at the second high level during other periods.

Each of the pixels may further include a second capacitor including a first terminal and a second terminal, the first terminal being coupled to a gate electrode of the driving transistor, a first transistor coupled between a corresponding data line of the data lines and the second terminal of the second capacitor, and configured to be turned on when a scan signal is supplied to a corresponding scan line of the scan lines, a third transistor coupled between the anode electrode of the organic light emitting diode and the gate electrode of the driving transistor and configured to be turned on when a corresponding one of control signals is supplied to a corresponding control line of the control lines, and a first capacitor coupled between the second terminal of the second capacitor and the first power driver.

The initializing transistor may be coupled between the anode electrode of the organic light emitting diode and a reset power supply configured to supply the reset voltage, the initializing transistor may also be configured to be turned on earlier than the third transistor.

The organic light emitting display device may further include one or more reset lines coupled to the pixels, wherein the control line driver is configured to supply reset signals to the one or more reset lines before the control signals are supplied to the control lines.

The reset signals supplied to the one or more reset lines may be concurrently supplied to all of the pixels.

The initializing transistor may be coupled between the anode electrode of the organic light emitting diode and a reset power supply configured to supply the reset voltage, the initializing transistor may also be configured to be turned on when a corresponding reset signal of reset signals is supplied.

The initializing transistor may be coupled between the anode electrode of the organic light emitting diode and the first power driver, and may be configured to be turned on when a corresponding reset signal of reset signals supplies a voltage of the first power driver at the first low level as the reset voltage.

A first electrode of the initializing transistor may be coupled to the anode electrode of the organic light emitting diode, and a second electrode and a gate electrode of the initializing transistor may be coupled to the first power driver.

The third transistor positioned on an i-th (i is a natural number) horizontal line may be configured to be turned on when an i-th control signal of the control signals is supplied to an i-th control line of the control lines, and the initializing transistor positioned on the i-th horizontal line and coupled between the anode electrode of the organic light emitting diode and a reset power supply configured to supply the reset voltage may be configured to be turned on when an i−1-th control signal of the control signals is supplied to an i−1-th control line of the control lines.

According to another aspect of embodiments of the present invention, there is provided a method of driving an organic light emitting display device, which includes a) supplying a reset voltage to an anode electrode of an organic light emitting diode included in pixels, b) charging a second capacitor included in the pixels with a voltage corresponding to a threshold voltage of a driving transistor and charging a first capacitor with a voltage corresponding to a data signal of data signals while sequentially supplying scan signals to scan lines, c) controlling a voltage of a gate electrode of the driving transistor while supplying the scan signals to the scan lines and supplying a voltage to data lines, and d) controlling an amount of current flowing to a second power supply from a first power supply through the organic light emitting diode in accordance with the voltage of the gate electrode of the driving transistor.

One frame may be implemented during a)-d).

Each of the pixels may include an initializing transistor coupled between the organic light emitting diode and a reset power supply supplying the reset voltage, wherein the initializing transistors included in the pixels may be concurrently turned on during a).

A power of the first power supply at a low level may be supplied during a), and the power of the first power supply at a high level may be supplied during b)-d).

A power of the second power supply at a high level may be supplied during a)-c), and the power of the second power supply at a low level may be supplied during d).

Each of the pixels may include an initializing transistor coupled between the organic light emitting diode and a reset power supply supplying the reset voltage, the initializing transistors included in the pixels may also be sequentially turned on line-by-line during a).

A power of the first power supply at a high level may be supplied during a)-d).

A power of the second power supply at a high level may be supplied during a)-c) and the power of the second power supply at a low level may be supplied during d).

The reset voltage may have a level lower than a first power supply voltage of the first power supply that is supplied during d).

The voltage to the data lines may be within a voltage range of the data signals corresponding to a plurality of gradations.

The voltage to the data lines may be lower than the voltage of the data signal having middle gradation.

An n-th (n is a natural number) frame may display a left-eye image and an n+1-th frame may display a right-eye image, with respect to a frame sequentially processed.

An entire time between an n-th emission period of the n-th frame and an n+1-th emission period of the n+1-th frame may be implemented in synchronization with a response time of shutter spectacles.

According to an organic light emitting display device of an embodiment of the present invention and a method of driving the organic light emitting display device, it is possible to compensate for the threshold voltage of a driving transistor, using pixels including four transistors and two capacitors. Further, the present invention can stably display a 3D image, because it operates in a concurrent (e.g., simultaneous) emission method.

BRIEF DESCRIPTION OF THE DRAWINGS

The accompanying drawings, together with the specification, illustrate exemplary embodiments of the present invention, and, together with the description, serve to explain the principles of embodiments of the present invention.

DETAILED DESCRIPTION

Figure 1:
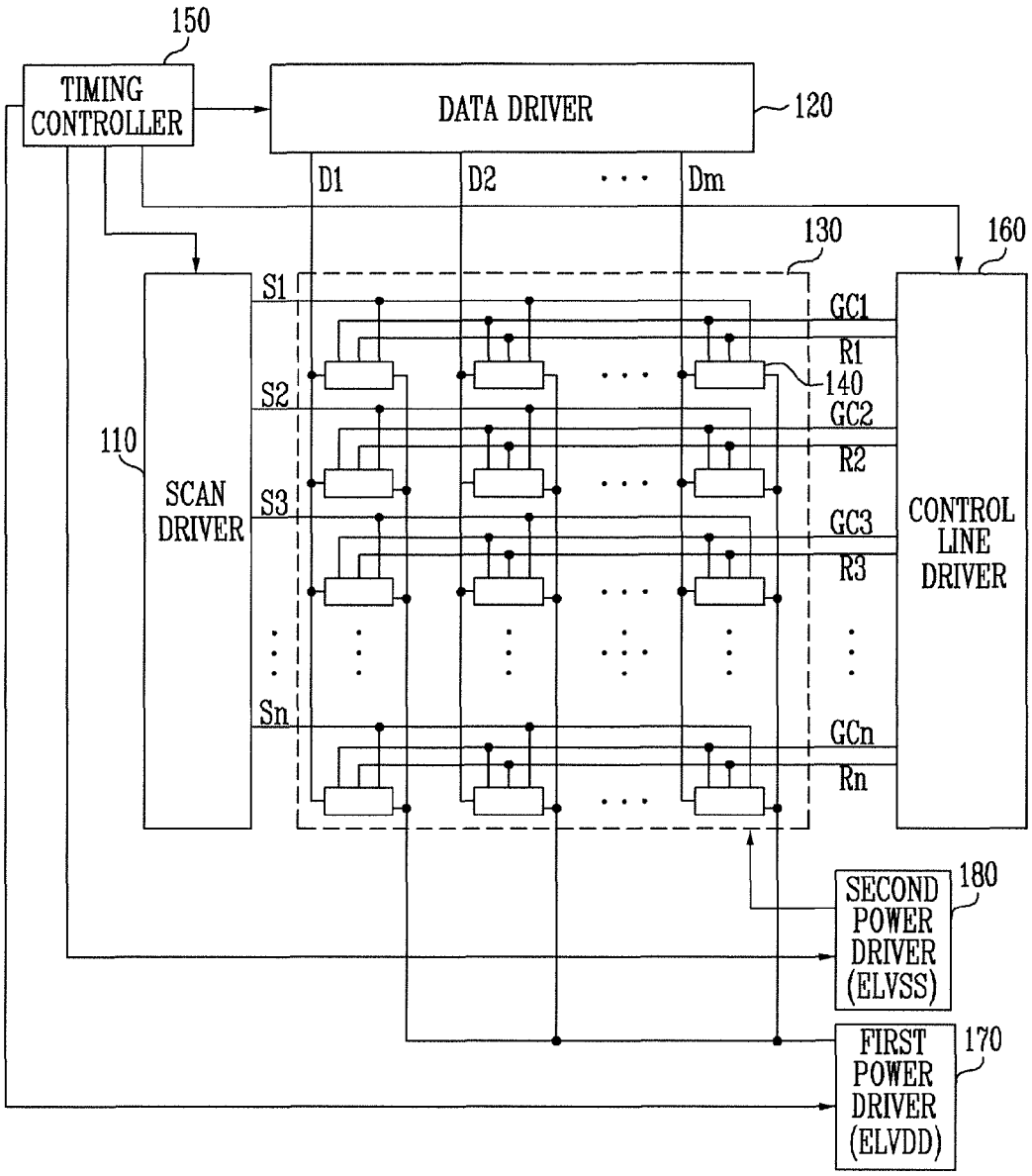
FIG. 1 is a block diagram illustrating an organic light emitting display device according to embodiments of the present invention.

Hereinafter, certain exemplary embodiments according to the present invention will be described with reference to the accompanying drawings. Here, when a first element is described as being coupled or connected to a second element, the first element may be directly coupled or connected to the second element but may be indirectly coupled to the second element via one or more other elements. Further, some of the elements that are not essential to a complete understanding of the invention are omitted for clarity. Also, like reference numerals refer to like elements throughout.

Exemplary embodiments of the present invention are described in detail with reference to FIGS. 1 to 10.

FIG. 1 is a block diagram illustrating an organic light emitting display device according to an embodiment of the present invention.

Referring to FIG. 1, an organic light emitting display device includes: a display unit 130 including pixels 140 coupled with scan lines S1 to Sn, control lines GC1 to GCn, reset lines R1 to Rn, and data lines D1 to Dm; a scan driver 110 for supplying scan signals to the scan lines S1 to Sn; a control line driver 160 for supplying control signals and reset signals to the control lines GC1 to GCn and the reset lines R1 to Rn, respectively; a data driver for 120 supplying data signals to the data lines D1 to Dm; and a timing controller 150 for controlling the scan driver 110, the data driver 120, and the control line driver 160.

Further, the organic light emitting display device according to an embodiment of the present invention includes a first power driver 170 for supplying power of a first power supply ELVDD to the pixels 140 and a second power driver 180 for supplying power of a second power supply ELVSS to the pixels 140.

The scan driver 110 supplies scan signals to the scan lines S1 to Sn. In one embodiment, the scan driver 110 sequentially or concurrently (e.g., simultaneously) supplies scan signals to the scan lines S1 to Sn during one frame period.

The data driver 120 supplies data signals to the data lines D1 to Dm in synchronization with the scan signals sequentially supplied to the scan lines S1 to Sn during the scan period. Further, the data driver 120 supplies voltage (e.g., predetermined voltage) to the data lines D1 to Dm during periods other than the period in which the data signals are supplied, in one frame period. For example, the data driver 120 supplies a voltage (e.g., a predetermined voltage) to the data lines D1 to Dm, in which the voltage is in the voltage range (e.g., 1-6V) of the data signals.

The control line driver 160 supplies control signals and reset signals to the control lines GC1 to GCn and the reset lines R1 to Rn, respectively. In one embodiment, the reset signals are concurrently (e.g., simultaneously) supplied to all of the pixels 140, and the control signals are concurrently (e.g., simultaneously) or sequentially supplied to all of the pixels 140 for each horizontal line. Therefore, as few as only one reset line may be installed to be coupled to all of the pixels 140. That is, one or more reset lines may be coupled to the pixels, corresponding to the design parameters in embodiments of the present invention.

The display unit 130 has the pixels 140 positioned at the crossing regions of the scan lines S1 to Sn and the data lines D1 to Dm. The pixels 140 are supplied with power from the first power supply ELVDD and the second power supply ELVSS. The pixels 140 control the amount of current supplied to a second power supply ELVSS through organic light emitting diodes from a first power supply ELVDD in response to the data signals, during the emission period in one frame period. Accordingly, light having luminance (e.g., predetermined luminance) is generated in the organic light emitting diode.

The first power driver 170 supplies power of the first power supply ELVDD to the pixels 140. In one embodiment, the first power driver 170 supplies power, which alternates between a high level and a low level, of the first power supply ELVDD during each frame period. In one embodiment, the high level of the power of the first power supply ELVDD implies voltage allowing current to flow in the pixels 140 and the low level implies voltage preventing current from flowing in the pixels 140.

The second power driver 180 supplies power of the second power supply ELVSS to the pixels 140. In one embodiment, the second power driver 180 supplies power, which alternates between a high level and a low level, of the second power supply ELVSS during each frame period. In one embodiment, the high level of the power of the second power supply ELVSS implies voltage preventing current from flowing in the pixels 140 and the low level implies voltage allowing current to flow in the pixels 140. For example, the pixels 140 emit light during the emission period in which the first power supply ELVDD is set at a high level and the second power supply ELVSS is set at a low level in one frame period.

Figure 2:
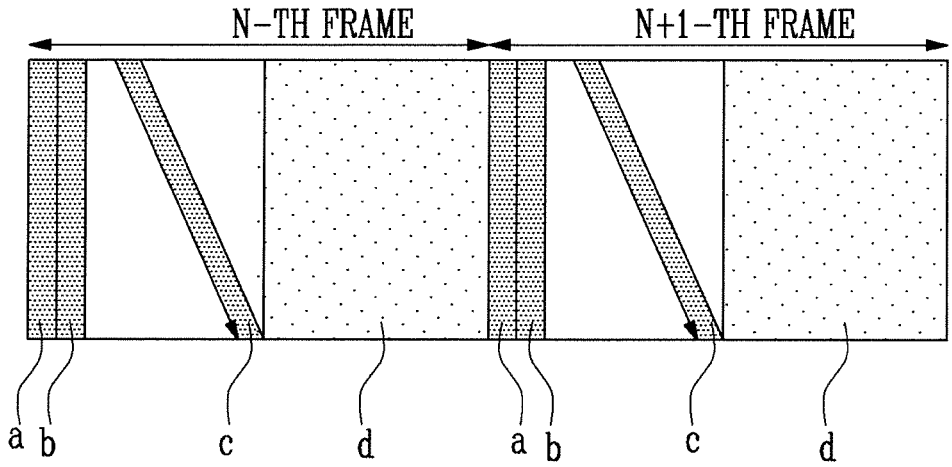
FIG. 2 is a diagram illustrating an operation in a concurrent (e.g., simultaneous) emission method according to an embodiment of the present invention.

FIG. 2 is a diagram illustrating a method of driving an organic light emitting display device according to an embodiment of the present invention.

Referring to FIG. 2, the organic light emitting display device according to one embodiment of the present invention operates in a concurrent (e.g., simultaneous) emission method. In general, the driving method is classified as a progressive emission method or a concurrent (e.g., simultaneous) emission method. The progressive emission method implies a method of sequentially inputting data to scan lines and sequentially emitting light by using pixels in each horizontal line in the same order of data input.

The concurrent (e.g., simultaneous) emission method implies a method of sequentially inputting data for each scan line and concurrently (e.g., simultaneously) emitting light by using pixels after the data is inputted to all of the pixels. One frame of embodiments according to the present invention driven in the concurrent (e.g., simultaneous) emission method is divided into (a) a reset period, (b) a threshold voltage compensation period, (c) a scan period, and (d) an emission period. In one embodiment, the pixels 140 are sequentially driven for each scan line during (c) the scan period, and all the pixels (140) are concurrently (e.g., simultaneously) driven during (a) the reset period, (b) the threshold voltage compensation period, and (d) the emission period.

The reset period (a) is a period in which the voltage of the driving transistors and the anode electrodes of the organic light emitting diodes, which are included in the pixels 140, are initialized to the voltage of reset power. In one embodiment, the reset power has a voltage lower than the voltage of the high-level first power and the high-level second power. For example, the voltage of the reset power may be the same as or lower than the voltage of the low-level second power source ELVSS such that the gate electrode of the driving transistor can be stably initialized.

The threshold voltage compensation period (b) is a period in which the threshold voltage of the driving transistors is compensated. Second capacitors included in the pixels 140 are charged with a voltage corresponding to the threshold voltage of the driving transistors during the threshold voltage compensation period.

The scan period (c) is a period in which data signals are supplied to the pixels 140. First capacitors included in the pixels 140 are charged with voltages corresponding to the data signals during the scan period.

The emission period (d) is a period in which the pixels 140 emit light in response to the data signals supplied during the scan period.

As described above, according to the driving method of embodiments of the present invention, it is possible to reduce the number of transistors in compensating circuits in the pixels 140 and signal lines, because the operational periods (a) to (d) are clearly separated in terms of time. Further, it is easy to implement a shutter spectacle type 3D display, because the operational periods (a) to (d) are clearly separated in terms of time.

The shutter spectacle type 3D display alternately outputs left-eye and right-eye images for each frame. A user wears "shutter spectacles" or "a pair of shutter glasses" of which the left-eye and right-eye transmittances switch in the range of about 0% to about 100%. The shutter spectacles supply the left-eye image and the right-eye image to the left eye and the right eye, respectively, such that the user recognizes a stereoscopic image.

Figure 3:
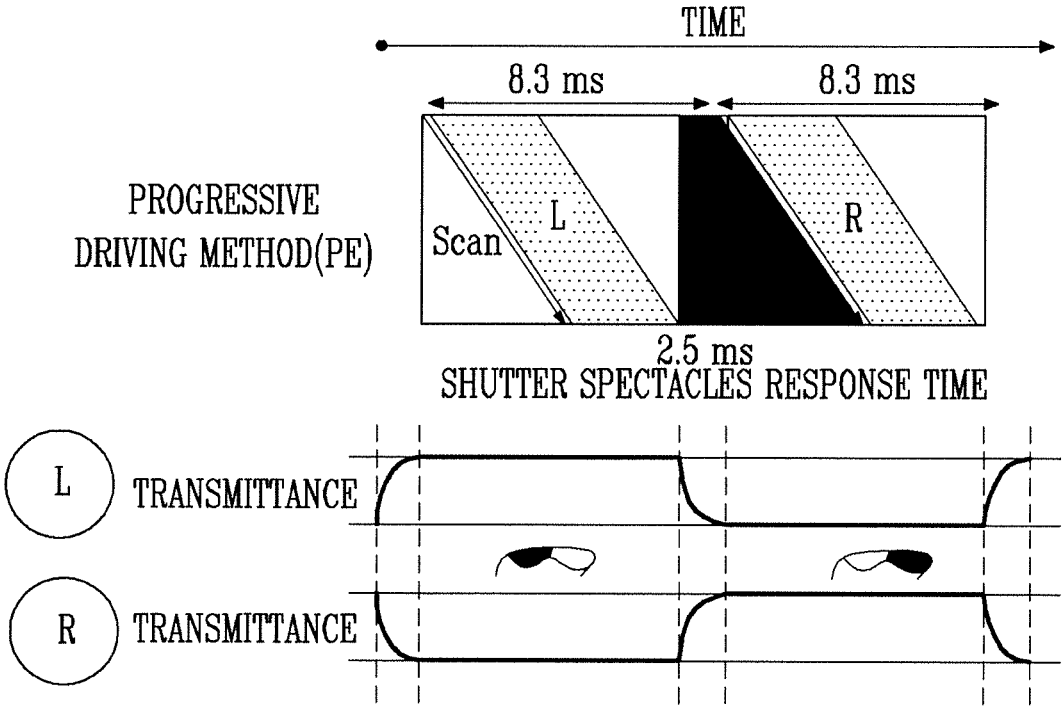
FIG. 3 is a diagram illustrating an example of implementing a shutter spectacle type 3D display in a progressive emission method.

FIG. 3 is a diagram illustrating an example of implementing a shutter spectacle type 3D in a progressive emission method.

Referring to FIG. 3, emission should be stopped for the response time of the shutter spectacles (e.g., 2.5 ms) in order to prevent or reduce cross talk between the left-eye/right-eye images when a screen is operated (e.g., outputted) by the progressive emission method. That is, a non-emission period is additionally provided for as long as the response time of the shutter spectacles between the frame (i-frame) (i is a natural number) outputting the left-eye image and the frame (i+1-frame) outputting the right-eye image, such that emission duty ratio decreases.

Figure 4:
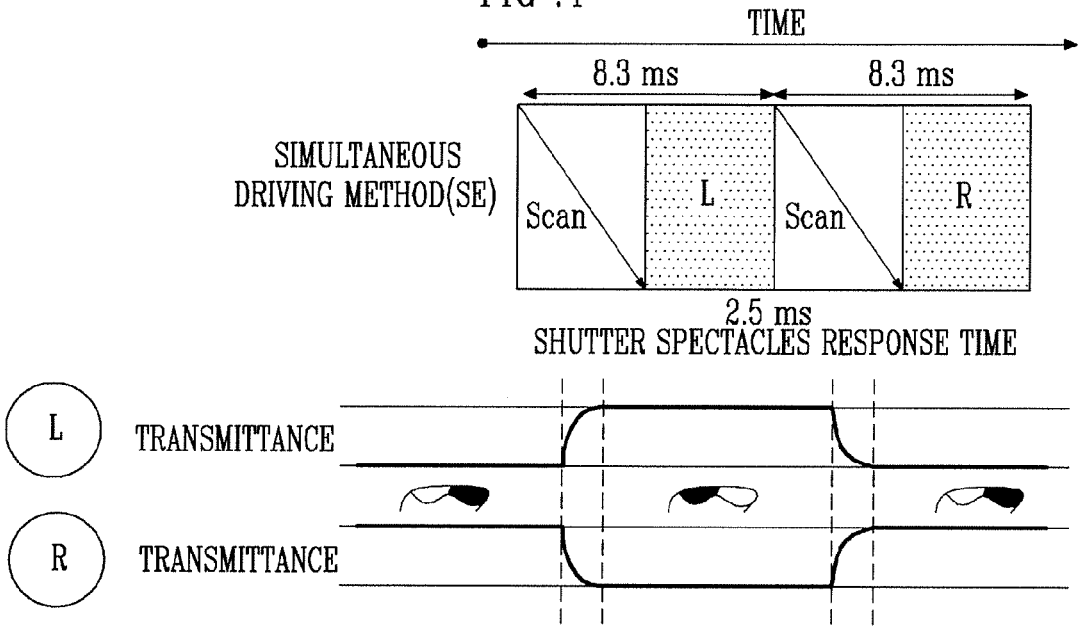
FIG. 4 is a diagram illustrating an example of implementing a shutter spectacle type 3D display in a concurrent (e.g., simultaneous) emission method according to an embodiment of the present invention.

FIG. 4 is a diagram illustrating an example of implementing a shutter spectacle type 3D display in a concurrent (e.g., simultaneous) emission method according to an embodiment of the present invention.

Referring to FIG. 4, light is concurrently (e.g., simultaneously) emitted from the entire display unit and the pixels 140 are set to a non-emission state in periods other than the emission period when a screen is operated (e.g., outputted) in the concurrent (e.g., simultaneous) emission method. Therefore, a non-emission period can be naturally ensured between the left-eye image output period and the right-eye image output period.

That is, the pixels 140 are set to the non-emission state for the reset period, threshold voltage compensation period, and scan period, between the i-frame and the i+1-frame, and it is not necessary to specifically reduce the emission duty ratio, unlike the progressive emission method of the related art, by synchronizing the above periods with the response time of the shutter spectacles.

Figure 5:
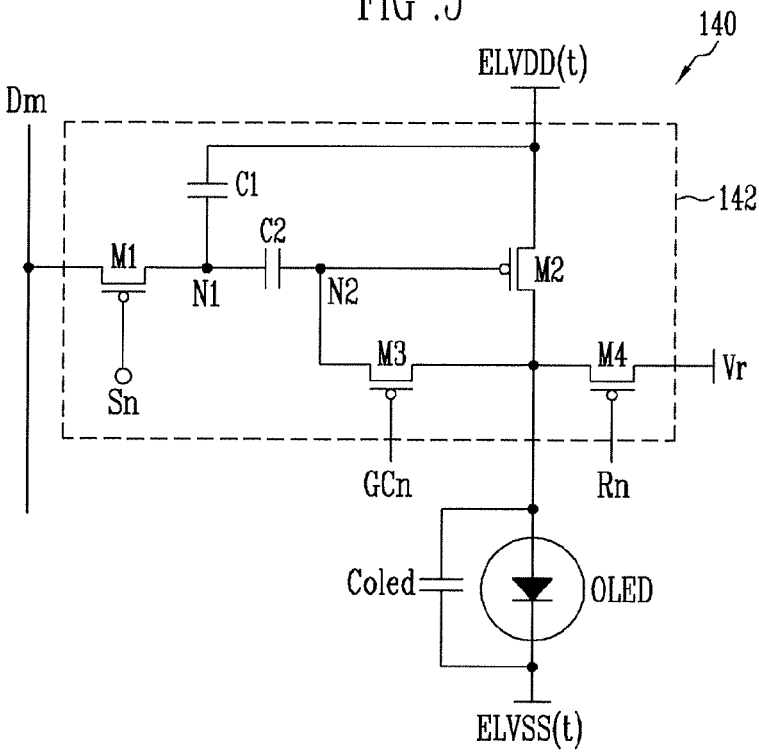
FIG. 5 is a diagram illustrating a first embodiment of a pixel shown in FIG. 1.

FIG. 5 is a circuit diagram illustrating a first embodiment of a pixel shown in FIG. 1. The pixel coupled to the n-th scan line Sn and the m-th data line Dm is shown in FIG. 5, for the convenience of description. Further, it should be assumed that the organic capacitor Coled shown in FIG. 5 is a capacitor parasitically formed in the organic light emitting diode OLED. The organic capacitor Coled typically has a capacity larger than the first capacitor C1 (or the second capacitor C2).

Referring to FIG. 5, the pixel 140 according to the first embodiment of the present invention includes an organic light emitting diode OLED and a pixel circuit 142 for controlling the amount of current supplied to the organic light emitting diode OLED.

The anode electrode of the organic light emitting diode OLED is coupled to the pixel circuit 142 and the cathode electrode is coupled to the second power supply ELVSS. The organic light emitting diode OLED produces light with luminance (e.g., predetermined luminance) in accordance with the current supplied from the pixel circuit 142.

The pixel circuit 142 is charged with a voltage corresponding to the data signal and the threshold voltage of a driving transistor M2, and controls the amount of current supplied to the organic light emitting diode OLED in accordance with the charged voltage. For this operation, the pixel circuit 140 includes four transistors M1 to M4 and two capacitors C1, C2.

A gate electrode of the first transistor M1 is coupled to the scan line Sn and a first electrode is coupled to the data line Dm. Further, a second electrode of the first transistor M1 is coupled to a first node N1. The first transistor M1 is turned on and electrically couples the data line Dm with the first node N1 when the scan signal is supplied to the scan line Sn. Throughout this specification, the first electrode of a transistor is one of a source or drain electrode and the second electrode of the transistor is the other one of the source or drain electrode.

The gate electrode of the second transistor M2 (driving transistor) is coupled to a second node N2 and the first electrode is coupled to the first power supply ELVDD. Further, the second electrode of the second transistor M2 is coupled to the anode of the organic light emitting diode OLED. The second transistor M2 controls the amount of current supplied to the organic light emitting diode OLED in response to the voltage applied to the second node N2.

A first electrode of the third transistor M3 is coupled to a second electrode of the second transistor M2 and a second electrode is coupled to second node N2. Further, the gate electrode of the third transistor M3 is coupled to the control line GCn. The third transistor M3 is turned on and diode-connects the second transistor M2 when a scan signal is supplied to the control line GCn.

A first electrode of the fourth transistor M4 is coupled to the anode electrode of the organic light emitting diode OLED and the second electrode is coupled to a reset power supply Vr. Further, the gate electrode of the fourth transistor M4 is coupled to a reset line Rn. The fourth transistor M4 is turned on and supplies voltage of the reset power supply Vr to the anode electrode of the organic light emitting diode OLED when a reset signal is supplied to the reset line Rn.

The first capacitor C1 is coupled between the first node N1 and the first power supply ELVDD. The first capacitor C1 is charged with a voltage corresponding to the data signal.

The second capacitor C2 is coupled between the first node N1 and the second node N2. The second capacitor C2 is charged with a voltage corresponding to the threshold voltage of the second transistor M2.

FIGS. 6A to 6E are diagrams illustrating a method of driving the embodiment of a pixel shown in FIG. 5. The first power supply ELVDD is set at a low level during a reset period, and at a high level during the threshold voltage compensation period, the scan period, and the emission period. The second power supply ELVSS is set at a high level during the reset period, the threshold voltage compensation period, and the scan period, and at a low level during the emission period. In one embodiment, the pixels 140 emit light during the period in which the first power supply ELVDD is set at a high level and the second power supply ELVSS is set at a low level, that is, during only the emission period.

Figure 6A:
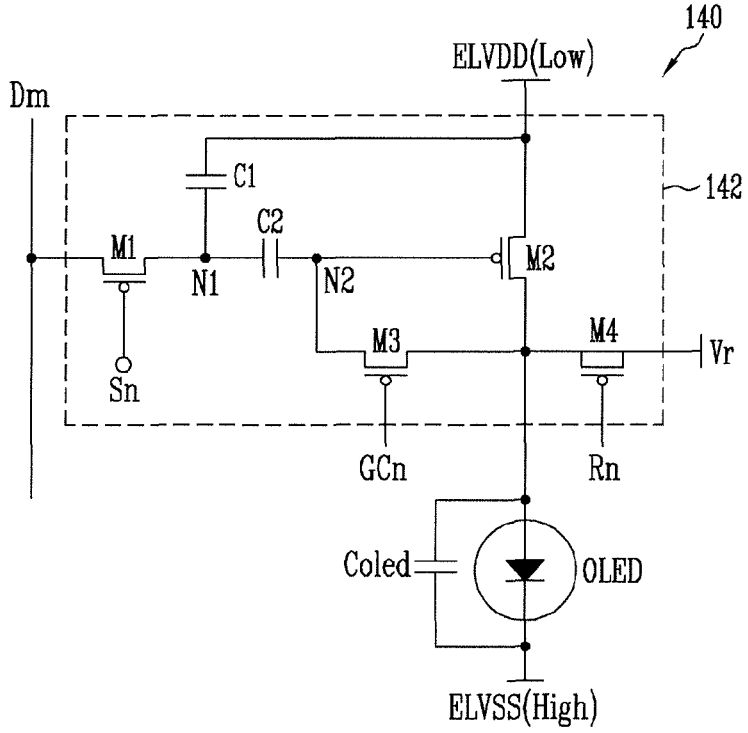
FIGS. 6A to 6E are diagrams illustrating a method of driving the pixel of the embodiment shown in FIG. 5.
Figure 6A:
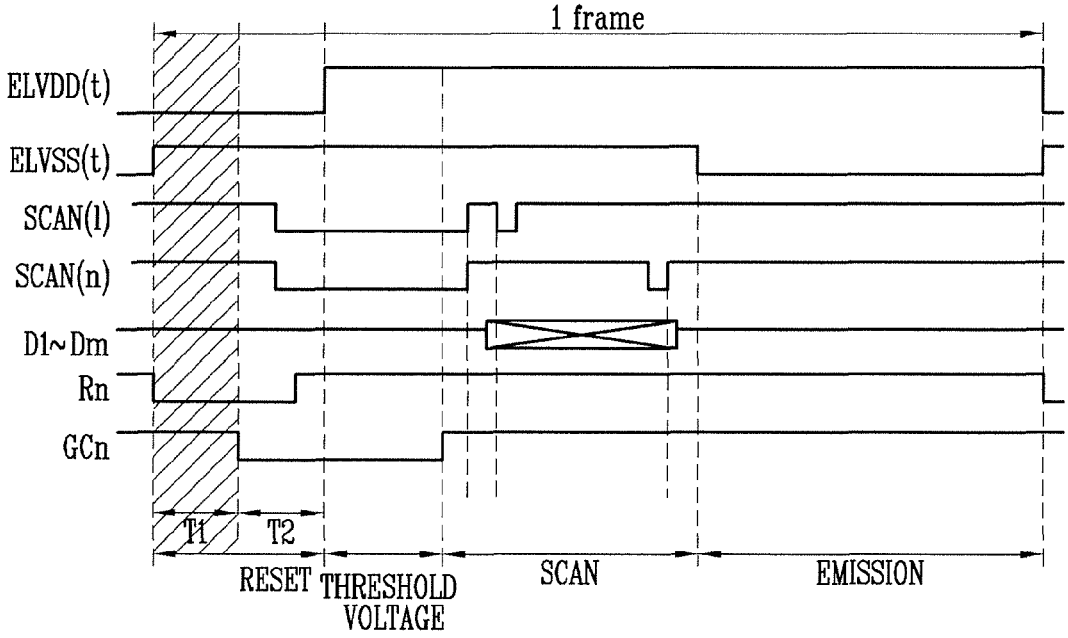

Referring to FIG. 6A, first, a reset signal is supplied to the reset line Rn during the reset period.

As the reset signal is supplied to the reset line Rn, the fourth transistor M4 is turned on. As the fourth transistor M4 is turned on, the voltage of the reset power supply Vr is supplied to the anode electrode of the organic light emitting diode OLED. That is, the anode electrode of the organic light emitting diode OLED is initialized to the voltage of the reset power supply Vr during a first period T1 in the reset period.

Figure 6B:
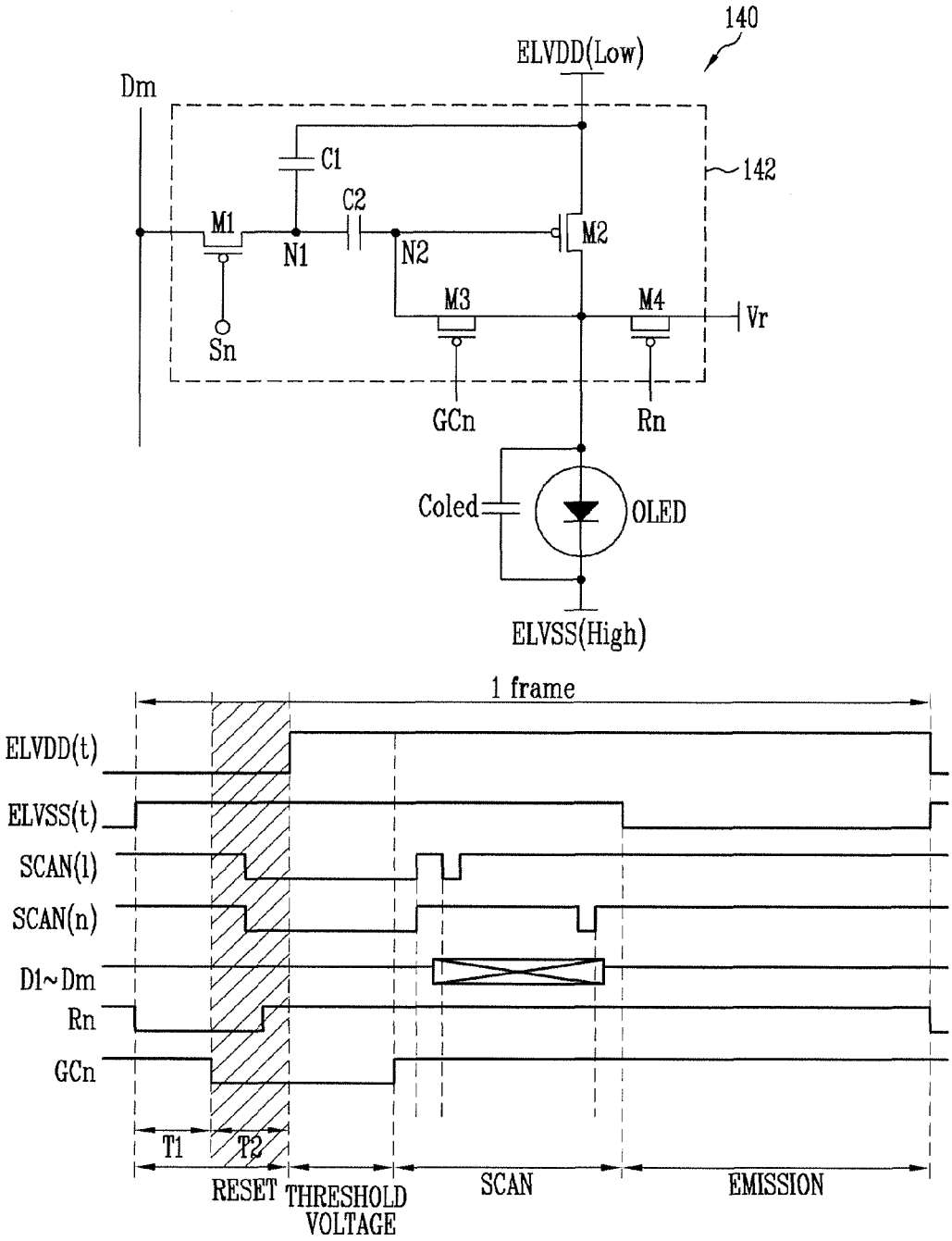

A control signal is supplied to the control line GCn during a second period T2 in the reset period, as shown in FIG. 6B. As the control signal is supplied to the control line GCn, the third transistor M3 is turned on. As the third transistor M3 is turned on, the voltage of the reset power supply Vr is supplied to the second node N2. That is, the second node N2 and the anode electrode of the organic light emitting diode OLED are initialized to the voltage of the reset power supply Vr during the reset period.

Figure 6C:
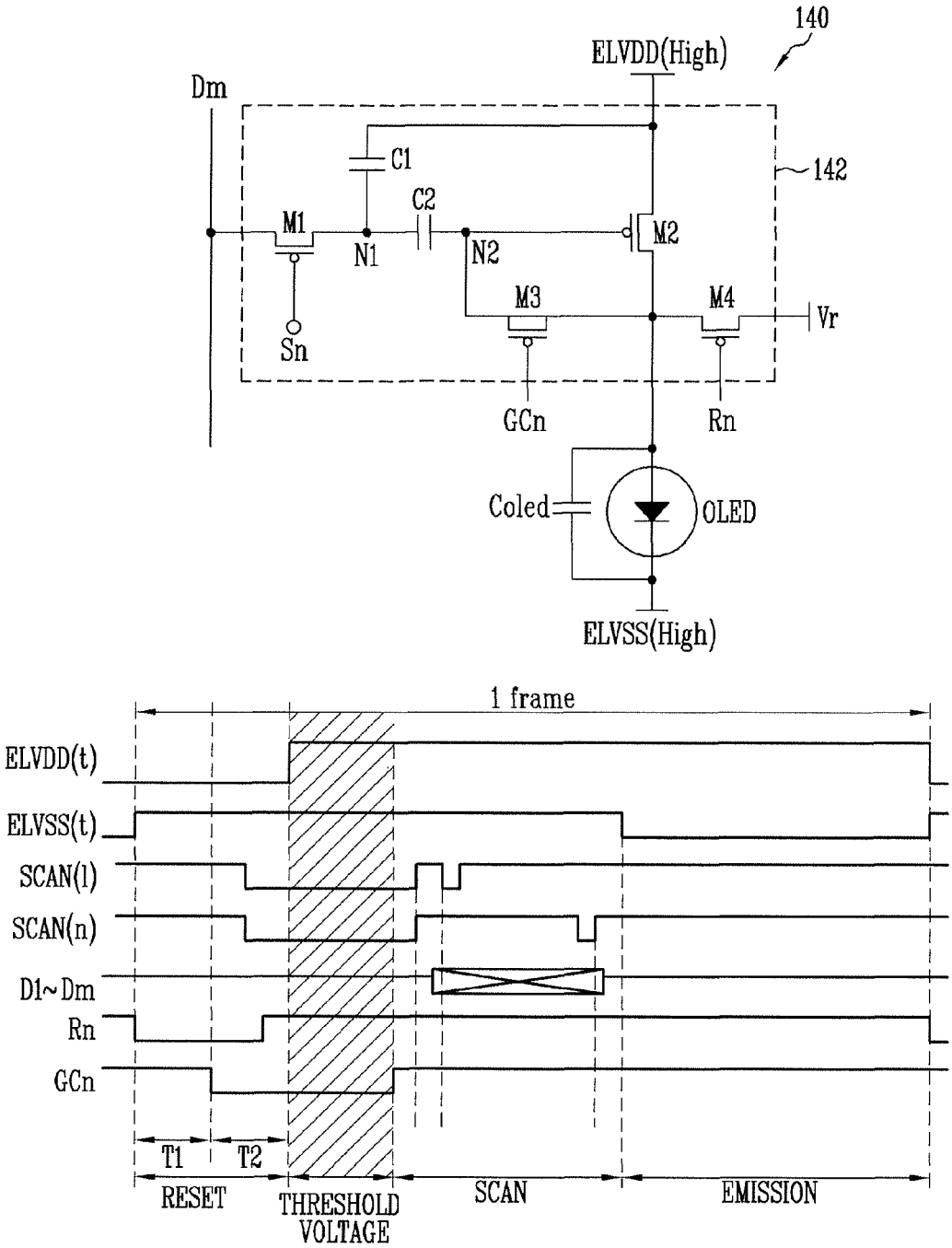

In the threshold voltage compensation period after the reset period, as shown in FIG. 6C, the control signals remain supplied to the control line GCn and the third transistor M3 remains turned on. Further, the supply of the reset signal to the reset line Rn is stopped and the fourth transistor M4 is turned off during the threshold voltage compensation period.

The second transistor M2 is diode-connected when the third transistor M3 is turned on. In this process, the second transistor M2 is turned on because the voltage of the second node N2 is initialized to the voltage of the reset power Vr. As the second transistor M2 is turned on, the voltage of the second node N2 increases up to a level obtained by subtracting the absolute value of the threshold voltage of the second transistor M2 from the high-level voltage of the first power supply ELVDD. The second transistor M2 is turned off after the voltage of the second node N2 rises to the level obtained by subtracting the absolute value of the threshold voltage of the second transistor M2 from the voltage of the first power supply ELVDD.

Meanwhile, a scan signal is supplied to the scan line Sn during the threshold voltage compensation period. As the scan signal is supplied to the scan line Sn, the first transistor M1 is turned on. The data line Dm and the first node N1 are electrically coupled when the first transistor M1 is turned on. In this process, a voltage (e.g., predetermined voltage) is supplied to the data lines D1 to Dm. The voltage (e.g., predetermined voltage) may be set (e.g., to a specific voltage) within the voltage range of a plurality of data signals, as described above, for example, voltage higher than that of a data signal corresponding to middle gradation.

During the threshold voltage compensation period, the second capacitor C2 is charged with a voltage between the first node N1 and the second node N2, that is, a voltage corresponding to the threshold voltage of the second transistor M2. In other words, the voltage (e.g., predetermined voltage) supplied to the first node N1 is set at the same level in all of the pixels 140, but the voltage supplied to the second node N2 is differently set for the pixels 140 and corresponds to the threshold voltage of the second transistor M2. Therefore, the voltage of the charged second capacitor C2 depends on the threshold voltage of the second transistor M2, such that it is possible to compensate for a threshold voltage difference of the second transistor M2.

Figure 6D:
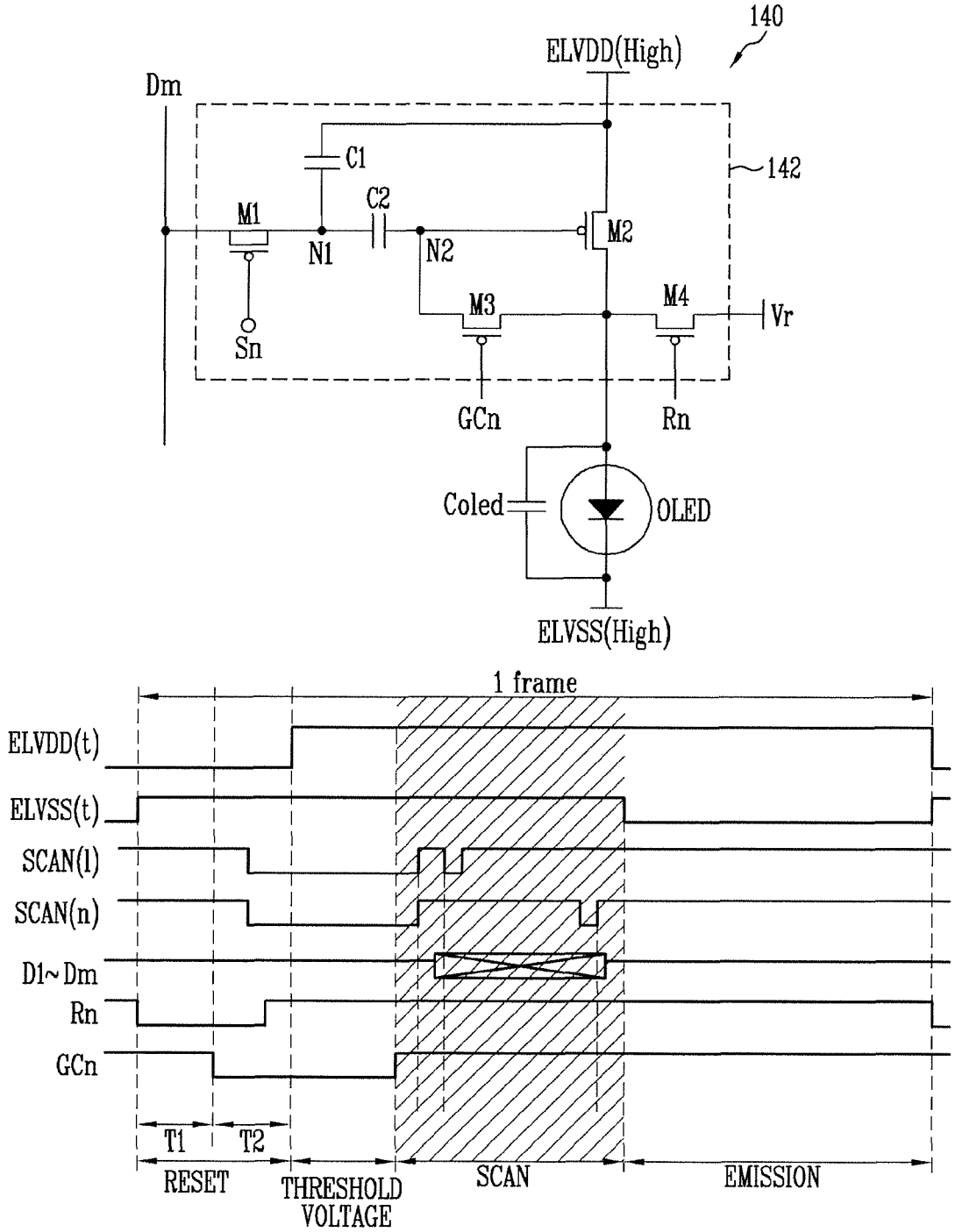

Thereafter, the scan signals are sequentially applied to the scan lines S1 to Sn, as shown in FIG. 6D, and the data signals are supplied to the data lines D1 to Dm in synchronization with the scan signals. As the scan signal is supplied to the scan line Sn, the first transistor M1 is turned on. A data signal from the data line Dm is supplied to the first node N1 when the first transistor M1 is turned on. In this process, the first capacitor C1 is charged with a voltage (e.g., predetermined voltage) corresponding to the data signal. Meanwhile, the second node N2 is set to a floating state during the scan period, such that the charged second capacitor C2 maintains the level provided in the previous period, regardless of voltage changes of the first node N1.

Figure 6E:
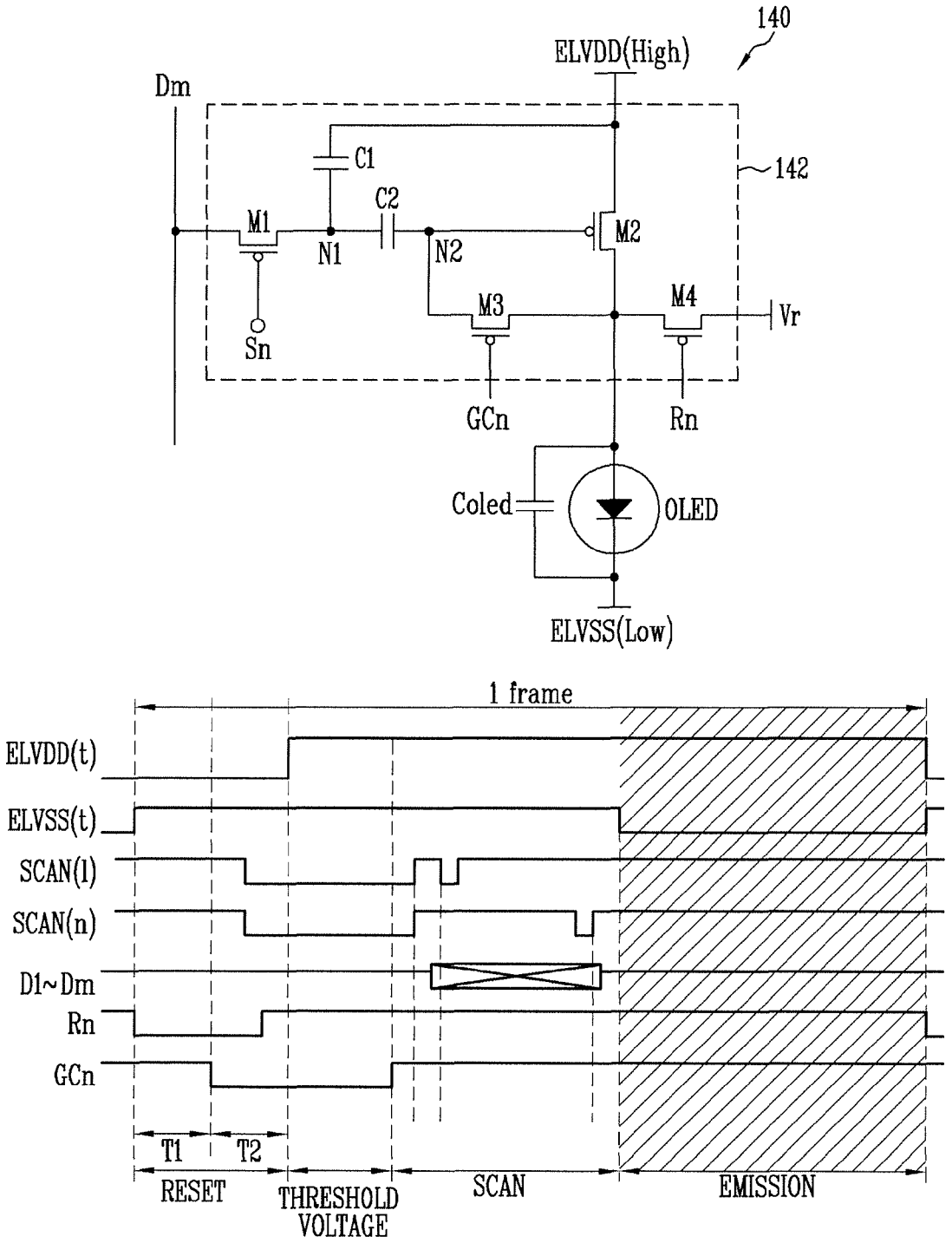

Low-level power of the second power supply ELVSS is supplied during the emission period and after the scan period, as shown in FIG. 6E. In this case, the second transistor M2 controls the amount of current flowing to the organic light emitting diode OLED in accordance with the voltage of the charged first and second capacitors C1, C2. Therefore, an image with luminance (e.g., predetermined luminance) corresponding to the data signal is displayed in the display unit 130 during the emission period.

Figure 7:
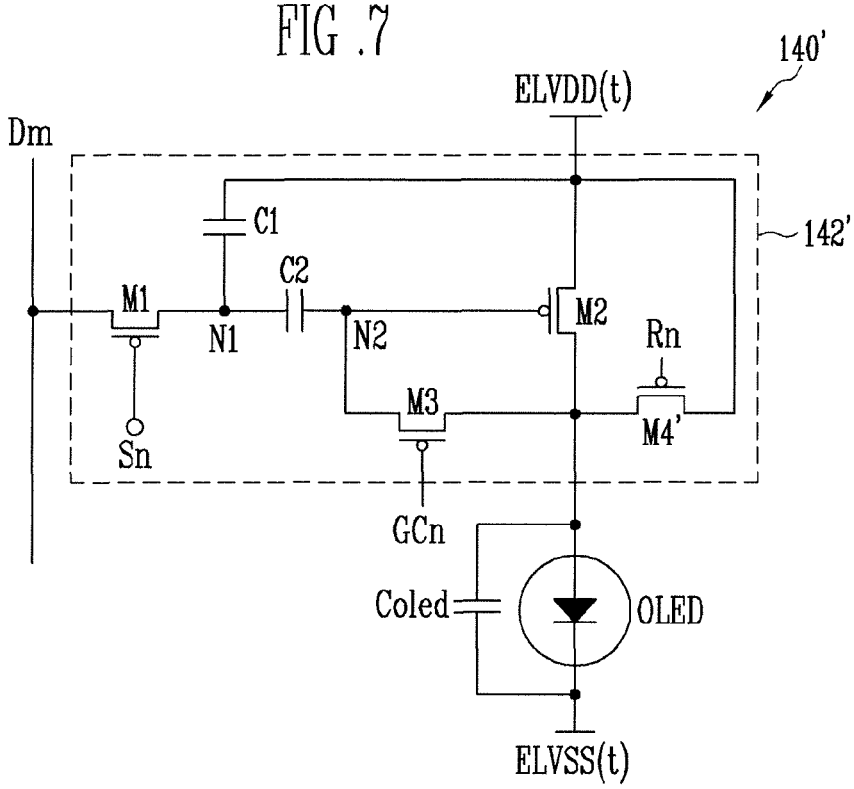
FIG. 7 is a diagram illustrating a second embodiment of a pixel shown in FIG. 1.

FIG. 7 is a circuit diagram illustrating a configuration of a second embodiment of the pixel shown in FIG. 1. In explaining FIG. 7, the same components as in FIG. 5 are designated by the same reference numerals and the detailed description thereof is not provided.

Referring to FIG. 7, a pixel 140' according to the second embodiment of the present invention includes an organic light emitting diode OLED and a pixel circuit 142' for controlling the amount of current supplied to the organic light emitting diode OLED. The pixel 140', for example, may replace the pixel 140 of FIG. 1 according to embodiments of the present invention.

A first electrode of the fourth transistor M4' included in the pixel circuit 142' is coupled to a second electrode of the second transistor M2 and a second electrode is coupled to the first power supply ELVDD. Further, the gate electrode of the fourth transistor M4' is coupled to a reset line Rn. The fourth transistor M4' is turned on and electrically couples the first power supply ELVDD with the anode electrode of the organic light emitting diode OLED when a reset signal is supplied to the reset line Rn.

The fourth transistor M4' is turned on and supplies the voltage of the first power supply ELVDD at a low level to the anode electrode of the organic light emitting diode OLED during the reset period. Therefore, the anode electrode of the organic light emitting diode OLED and the second node N2 are set to the voltage of the first power supply ELVDD during the reset period.

That is, the pixel 140' according to the second embodiment of the present invention initializes the second node N2 and the anode electrode of the organic light emitting diode OLED by using the first power supply ELVDD at a low level and without using a specific reset power supply. In this case, since the reset power supply is not used, a power line for connecting the reset power supply with the fourth transistor M4' may not be required. Meanwhile, the pixel 140' according to the second embodiment of the present invention initializes the second node N2 and the anode electrode of the organic light emitting diode OLED using the first power supply ELVDD at a low level, and the others in the driving method are substantially the same as the pixel shown in FIG. 5 and the detailed description thereof is not provided.

Figure 8:
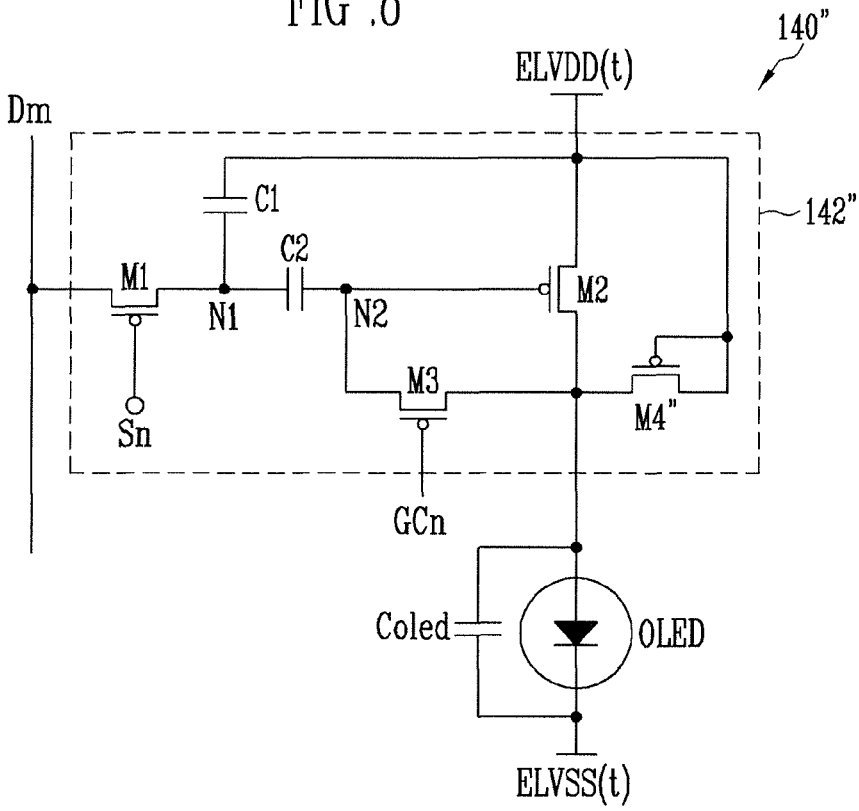
FIG. 8 is a diagram illustrating a third embodiment of a pixel shown in FIG. 1.

FIG. 8 is a circuit diagram illustrating a configuration of a third embodiment of the pixel shown in FIG. 1. In explaining FIG. 8, the same components as in FIG. 5 are designated by the same reference numerals and the detailed description thereof is not provided.

Referring to FIG. 8, a pixel 140" according to the third embodiment of the present invention includes an organic light emitting diode OLED and a pixel circuit 142" for controlling the amount of current supplied to the organic light emitting diode OLED. The pixel 140", for example, may replace the pixel 140 of FIG. 1 according to embodiments of the present invention.

A first electrode of the fourth transistor M4" included in the pixel circuit 142" is coupled to a second electrode of the second transistor M2 and a second electrode and a gate electrode are coupled to the first power supply ELVDD. That is, the fourth transistor M4" is diode-connected such that current can flow from the anode electrode of the organic light emitting diode OLED to the first power supply ELVDD.

When the fourth transistor M4" is diode-connected, the voltage of the anode electrode of the organic light emitting diode OLED corresponds to the voltage of the first power supply ELVDD at a low level during the period in which low-level power of the first power supply ELVDD is supplied, that is, the reset period (the voltage is set substantially higher than the first power supply at a low level, because of the threshold voltage of the fourth transistor M4"). Further, the voltage of the second node N2 is also substantially set to the low-level voltage of the first power supply ELVDD during the second period in the reset period in which the third transistor M3 is turned on.

That is, the pixel 140" according to the third embodiment of the present invention initializes the second node N2 and the anode electrode of the organic light emitting diode OLED using the diode-connected fourth transistor M4" and without using a specific reset power supply and a reset line. In this case, the reset power supply and the reset line are not used. Meanwhile, the pixel 140' according to the second embodiment of the present invention initializes the second node N2 and the anode electrode of the organic light emitting diode OLED using the fourth transistor M4' (see FIG. 7) coupled in a diode shape, and the others in the driving method are the same as the pixel shown in FIG. 5 and the detailed description thereof is not provided.

Figure 9:
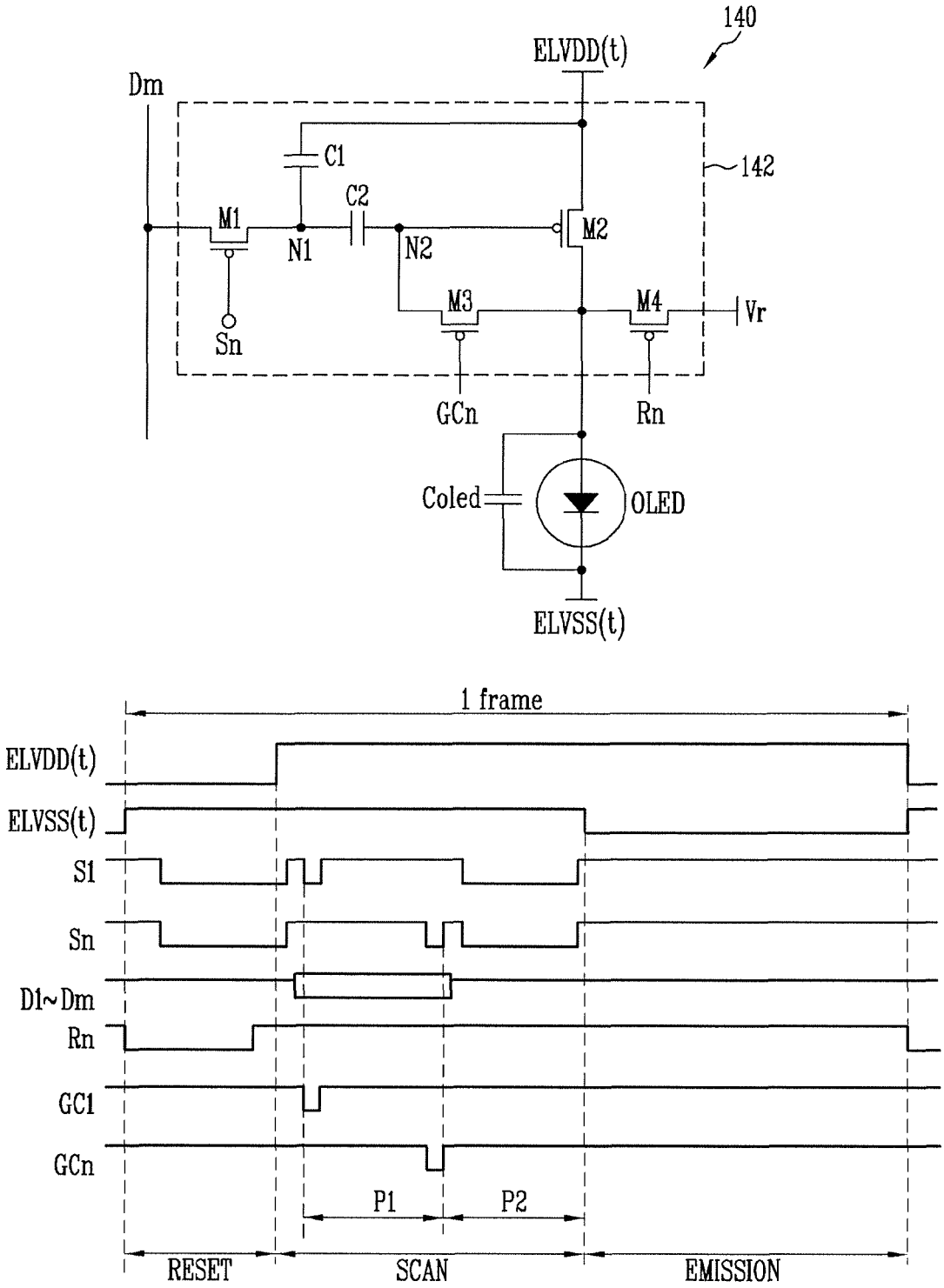
FIG. 9 is a waveform diagram illustrating a driving method according to another embodiment of the present invention.
Figure 10:
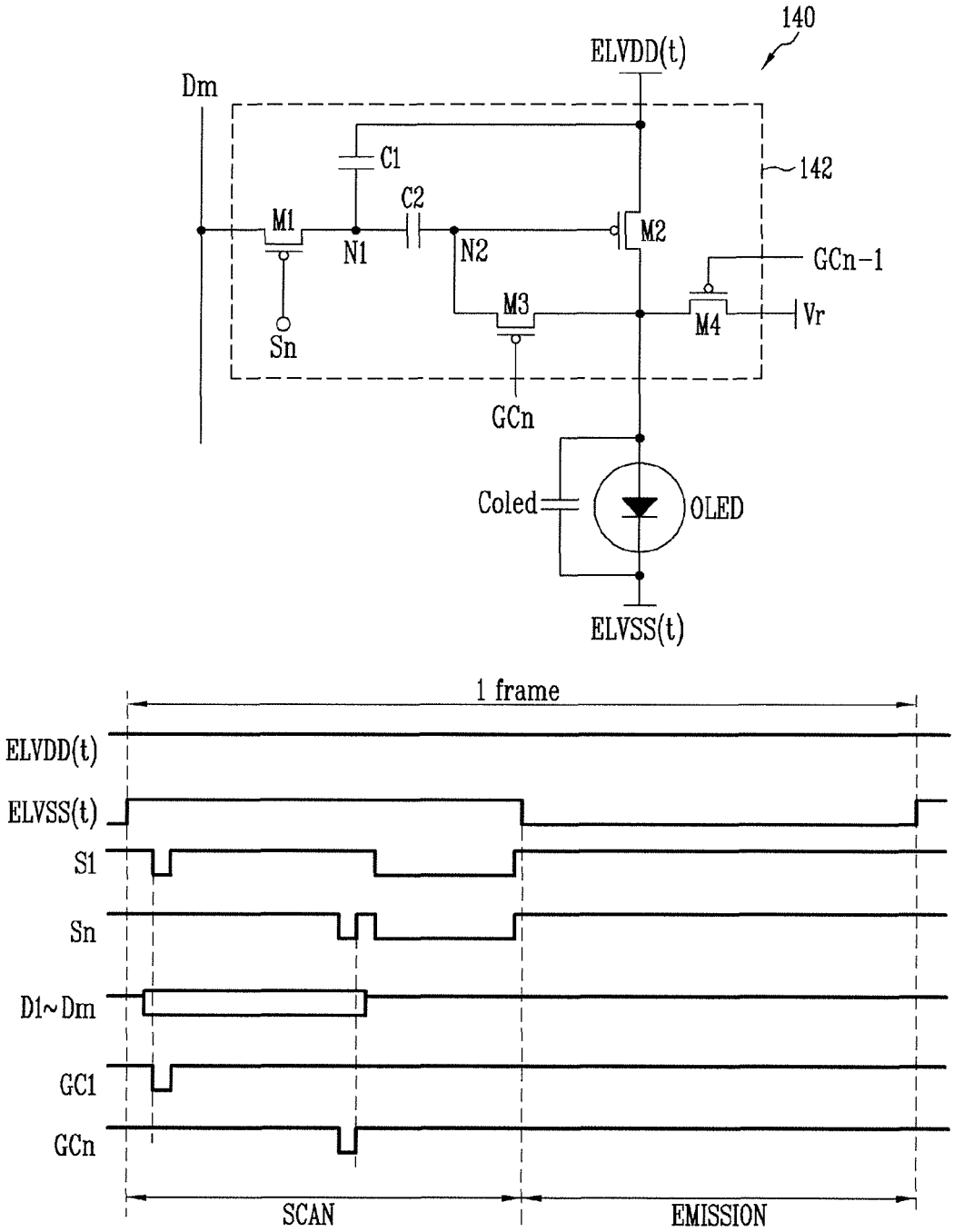
FIG. 10 is a waveform diagram illustrating a driving method according to another embodiment of the present invention.

Meanwhile, in the driving method illustrated in FIGS. 6A to 6E, one frame period is divided into the reset period, threshold voltage compensation period, scan period, and emission period, but the present invention is not limited thereto. For example, the waveform may be freely set such that the capacitors C1, C2 can be charged with a desired voltage during the other periods, other than the emission period, in embodiments of the present invention. For example, as shown in FIG. 9, the threshold voltage of the second transistor M2 can be compensated for during the scan period where scan signals are sequentially supplied to the scan lines 51 to Sn. For example, as shown in FIG. 10, the second node N2 can be initialized and the threshold voltage thereof can be compensated for during the period where scan signals are sequentially supplied to the scan lines S1 to Sn.

FIG. 9 is a waveform diagram illustrating a driving method according to another embodiment of the present invention.

Referring to FIG. 9, one frame period is divided into a reset period, a scan period, and an emission period. The voltage of the anode electrode of the organic light emitting diode OLED is initialized in the reset period. The capacitors C1, C2 are charged with a voltage corresponding to the data signal and the threshold voltage of the second transistor M2 during the scan period. A current (e.g., predetermined current) is supplied to the organic light emitting diode OLED in accordance with the voltage applied to the second node N2 in the emission period.

The first power supply ELVDD is set at a low level during a reset period, and at a high level during the scan period and the emission period. The second power supply ELVSS is set at a high level during the reset period and the scan period, and at a low level during the emission period. In embodiments according to the present invention, the pixels 140 emit light during the period where the first power supply ELVDD is set at a high level and the second power supply ELVSS is set at a low level, that is, during only the emission period.

Explaining the operation process, a reset signal is first supplied to the reset line Rn during the reset period. As the reset signal is supplied to the reset line Rn, the fourth transistor M4 is turned on. As the fourth transistor M4 is turned on, the voltage of the reset power supply Vr is supplied to the anode electrode of the organic light emitting diode OLED. That is, the anode electrode of the organic light emitting diode OLED is initialized to the voltage of the reset power supply Vr, during the reset period.

Meanwhile, scan signals are supplied (e.g., simultaneously supplied) to the scan lines S1 to Sn during some periods in the reset period. As the scan signals are supplied to the scan line Sn, the first transistor M1 is turned on, and the first node N1 and the data line Dm are electrically coupled. In this process, a voltage (e.g., predetermined voltage) is supplied to the first node N1 from the data line Dm.

As the scan signals are supplied to scan lines S1 to Sn during some periods in the reset period, as described above, voltage (e.g., predetermined voltage) is supplied to the first nodes N1 included in all of the pixels 140. In other words, the same voltage is supplied to the first nodes N1 in all of the pixels 140, and accordingly, it is possible to improve reliability in driving.

Scan signals are sequentially supplied to the scan lines S1 to Sn and control signals are sequentially supplied to the control lines GC1 to GCn during a first period P1 in the scan period. In one embodiment, the scan signal supplied to the i-th (i is a natural number) scan line Si is supplied in synchronization with the control signal supplied to the i-th control line GCi. Further, data signals are supplied to the data lines D1 to Dm in synchronization with the scan signals during the scan period.

As the scan signal is supplied to the scan line, the first transistor M1 is turned on, and as the control signal is supplied to the control line GCn, the third transistor M3 is turned on. A data signal from the data line Dm is supplied to the first node N1, when the first transistor M1 is turned on.

As the third transistor M3 is turned on, the voltage of the second node N2 drops substantially to the voltage of the reset power supply Vr. For example, as the third transistor M3 is turned on, the second node N2 and the anode electrode of the organic light emitting diode OLED are electrically coupled. In this process, the voltage of the second node N2 is dropped by the voltage of the reset power supply at which the organic capacitor Coled is charged.

In this process, the second transistor M2 that is diode-connected is turned on after the voltage of the second node N2 drops. That is, the voltage of the second node N2 is set to a lower level than the voltage of the first power supply ELVDD at a high level, and accordingly, the second transistor is turned on. As the second transistor M2 is turned on, the voltage of the second node N2 increases up to a level obtained by subtracting the absolute value of the threshold voltage of the second transistor M2 from the high-level voltage of the first power supply ELVDD. The second transistor M2 is turned off after the voltage of the second node N2 rises to the level obtained by subtracting the absolute value of the threshold voltage of the second transistor M2 from the voltage of the first power supply ELVDD.

In one embodiment, the second capacitor C2 is charged with a voltage corresponding to the data signal applied to the first node N1 and the threshold voltage of the second transistor M2. Further, the first capacitor C1 is charged with a voltage corresponding to a difference between the data signal and the power of the first power supply at a high level. That is, the second capacitor C2 is charged with a voltage corresponding to the threshold voltage of the second transistor, and the capacitor C1 is charged with a voltage corresponding to the data signal during the first period P1 in the scan period.

Scan signals are supplied (e.g., simultaneously supplied) to the scan lines S1 to Sn during a second period P2 of the scan period. In this process, voltage (e.g., predetermined voltage) is supplied to the data lines D1 to Dm.

As the scan signal is supplied to the scan line Sn, the first transistor M1 is turned on. A voltage (e.g., predetermined voltage) is supplied from the data line Dm to the first node N1 when the first transistor M1 is turned on. In this process, the voltage of the first node N1 changes from the voltage of the data signal to the voltage (e.g., predetermined voltage), and the voltage of the second node N2 changes in response to the amount of change of voltage of the first node N1.

The voltage (e.g., predetermined voltage) is set within the voltage range (e.g. 1-6V) of the data signals, for example, lower than the voltage of the data signal having middle gradation. For example, the voltage of the second node N2 is set to a value obtained by subtracting the threshold voltage of the second transistor M2 from the first power supply ELVDD at a high level during the first period P1. Therefore, the voltage of the second node N2 is controlled to control the amount of current supplied to the organic light emitting diode OLED from the second transistor by the voltage (e.g., predetermined voltage) supplied to the first node N1 during the second period P2.

For example, a voltage (e.g., the predetermined voltage) of 2V may be supplied when the data signals have a voltage range of 1-6V. In this case, the voltage of the second node N2 is increased by the voltage of 2V supplied to the first node N1 during the second period P2, and accordingly, black gradation can be displayed when a data signal at 1V is supplied during the first period P1.

In this case, the voltage of the second node N2 is maintained by the voltage of 2V supplied to the first node N1 during the second period P2, and accordingly, minute gradation can be implemented when a data signal at 2V is supplied during the first period P1. Further, the voltage of the second node N2 is decreased by the voltage of 2V supplied to the first node N1 during the second period P2, and accordingly, white gradation can be implemented when a data signal at 6V is supplied during the first period P1.

The second power supply ELVSS is set at a low level during the emission period. In this case, the second transistor M2 controls the amount of current flowing to the organic light emitting diode OLED in response to the voltage applied to the second node N2. Therefore, an image with predetermined luminance corresponding to the data signal is displayed in the display unit 130 during the emission period.

FIG. 10 is a waveform diagram illustrating a driving method according to another embodiment of the present invention.

Referring to FIG. 10, one frame reset period is divided into a scan period and an emission period.

The capacitors C1, C2 are charged with a voltage corresponding to the data signal and the threshold voltage of the second transistor M2 during the scan period. In one embodiment, the scan period includes a process of initializing the voltage of the anode electrode of the organic light emitting diode OLED to a voltage of the reset power supply Vr. Meanwhile, the gate electrode of the fourth transistor of the n-th horizontal line is coupled to the n−1-th control line GCn-1, so that the anode electrode of the organic light emitting diode OLED can be initialized during the scan period in the described embodiment of the present invention. The structure of the pixel 140, except for those described above, is the same as that of the embodiment shown in FIG. 5 and the detailed description thereof is not provided.

A current (e.g., predetermined current) is supplied to the organic light emitting diode OLED in response to the voltage applied to the second node N2 in the emission period.

The first power supply ELVDD maintains a high level during one frame period. The second power supply ELVSS is set at a high level during the scan period, and is set at a low level during the emission period. In this state, the pixel 140 produces light with a luminance (e.g., predetermined luminance) during only the emission period where the second power source ELVSS is set at a low level.

Explaining the operation process, first, scan signals are sequentially supplied to the scan lines S1 to Sn and control signals are sequentially supplied to the control lines GC1 to GCn during the scan period. In the described embodiment, the scan signal supplied to the i-th (i is a natural number) scan line Si is supplied in synchronization with the control signal supplied to the i-th control line GCi. Further, data signals are supplied to the data lines D1 to Dm in synchronization with the scan signals during the scan period.

As the control signal is supplied to the n−1-th control line GCn-1, the fourth transistor M4 is turned on. As the fourth transistor M4 is turned on, the voltage of the reset power supply Vr is supplied to the anode electrode of the organic light emitting diode OLED. That is, the anode electrode of the organic light emitting diode OLED is initialized to the voltage of the reset power supply Vr, during the period where the control signal is supplied to the n−1-th control signal GCn-1.

As the scan signal is supplied to the scan line, the first transistor M1 is turned on, and as the control signal is supplied to the control line GCn, the third transistor M3 is turned on. A data signal from the data line Dm is supplied to the first node N1 when the first transistor M1 is turned on. As the third transistor M3 is turned on, the voltage of the second node N2 is dropped by the voltage of the reset power supply at which the organic capacitor Coled is charged.

In this process, the second transistor M2 that is diode-connected is turned on after the voltage of the second node N2 drops. That is, the voltage of the second node N2 is set to a lower level than the voltage of the first power supply ELVDD at a high level, and accordingly, the second transistor is turned on. As the second transistor M2 is turned on, the voltage of the second node N2 increases up to a level obtained by subtracting the absolute value of the threshold voltage of the second transistor M2 from the high-level voltage of the first power supply ELVDD. The second transistor M2 is turned off after the voltage of the second node N2 rises to the level obtained by subtracting the absolute value of the threshold voltage of the second transistor M2 from the voltage of the first power supply ELVDD.

In one embodiment, the second capacitor C2 is charged with a voltage corresponding to the data signal applied to the first node N1 and the threshold voltage of the second transistor M2. Further, the first capacitor C1 is charged with a voltage corresponding to a difference between the data signal and the power of the first power supply at a high level.

Thereafter, the first capacitor C1 and the second capacitor C2 are charged with a voltage (e.g., predetermined voltage) and then scan signals are supplied (e.g., simultaneously supplied) to the scan lines S1 to Sn. In this process, voltage (e.g., predetermined voltage) is supplied to the data lines D1 to Dm.

As the scan signal is supplied to the scan line Sn, the first transistor M1 is turned on. A voltage (e.g., predetermined voltage) is supplied from the data line Dm to the first node N1 when the first transistor M1 is turned on. In this process, the voltage of the first node N1 is changed from the voltage of the data signal to the voltage (e.g., predetermined voltage), and the voltage of the second node N2 changes in response to the amount of change of voltage of the first node N1.

The second power supply ELVSS is set at a low level during the emission period. In this case, the second transistor M2 controls the amount of current flowing to the organic light emitting diode OLED in response to the voltage applied to the second node N2. Therefore, an image with a luminance (e.g., predetermined luminance) corresponding to the data signal is displayed in the display unit 130 during the emission period.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a display unit comprising pixels coupled to scan lines and data lines;

control lines coupled to the pixels;

a control line driver configured to supply control signals to the pixels through the control lines;

a first power driver configured to apply first power, which changes between a first low level and a first high level, to the pixels; and a second power driver configured to apply second power, which changes between a second low level and a second high level, to the pixels, wherein each of the pixels comprises:

an organic light emitting diode;

a driving transistor configured to control an amount of current supplied to the organic light emitting diode;

an initializing transistor coupled to an anode electrode of the organic light emitting diode and configured to be turned on during a reset period in one frame to supply a reset voltage, which is lower than the first high level of the first power, to the anode electrode of the organic light emitting diode;

a second capacitor comprising a first terminal and a second terminal, the first terminal being coupled to a gate electrode of the driving transistor;

a first transistor coupled between a corresponding data line of the data lines and the second terminal of the second capacitor, and configured to be turned on when a scan signal is supplied to a corresponding scan line of the scan lines;

a first capacitor coupled between the second terminal of the second capacitor and the first power driver; and a third transistor coupled between the anode electrode of the organic light emitting diode and the gate electrode of the driving transistor and configured to be turned on when a corresponding one of control signals is supplied to a corresponding control line of the control lines, wherein the initializing transistor is coupled between the anode electrode of the organic light emitting diode and a reset power supply configured to supply the reset voltage, the initializing transistor being configured to be turned on earlier than the third transistor.

2. The organic light emitting display device as claimed in claim 1, further comprising:

a scan driver configured to supply scan signals to the scan lines;

a data driver configured to supply data signals to the data lines in synchronization with the scan signals; and a timing controller configured to control the scan driver, the data driver, and the control line driver.

3. The organic light emitting display device as claimed in claim 1, wherein the first power driver is configured to supply the first power at the first high level during a period in which the pixels are charged with a voltage corresponding to a threshold voltage of the driving transistor and data signals, and during a period in which the pixels emit light, and is configured to supply the first power at the first low level during other periods.

4. The organic light emitting display device as claimed in claim 1, wherein the second power driver is configured to supply the second power at the second low level during a period in which the pixels concurrently emit light, and is configured to supply the second power at the second high level during other periods.

5. The organic light emitting display device as claimed in claim 1, further comprising one or more reset lines coupled to the pixels, wherein the control line driver is configured to supply reset signals to the one or more reset lines before the control signals are supplied to the control lines.

6. The organic light emitting display device as claimed in claim 5, wherein the reset signals supplied to the one or more reset lines are concurrently supplied to all of the pixels.

7. The organic light emitting display device as claimed in claim 1, wherein the initializing transistor is configured to be turned on when a corresponding reset signal of reset signals is supplied.

8. The organic light emitting display device as claimed in claim 1, wherein the initializing transistor is coupled between the anode electrode of the organic light emitting diode and the first power driver, and is configured to be turned on when a corresponding reset signal of reset signals supplies a voltage of the first power driver at the first low level as the reset voltage.

* * * * *